United States Patent [19]

Tani

[11] Patent Number: 4,981,121

[45] Date of Patent: Jan. 1, 1991

[54] STARTING-STOPPING DEVICE FOR SMALL SIZED JET PROPULSION BOAT

[75] Inventor: Satoshi Tani, Iwata, Japan

[73] Assignee: Yamaha Hatsudoki Kabushiki Kaisha, Iwata, Japan

[21] Appl. No.: 320,175

[22] Filed: Mar. 7, 1989

[30] Foreign Application Priority Data

Mar. 10, 1988 [JP] Japan ..... 63-57922

[51] Int. Cl.[5] ..... F02D 11/02

[52] U.S. Cl. ..... 123/179 A; 123/179 BG; 123/198 DC; 200/61.85; 307/10.6

[58] Field of Search ..... 123/179 A, 179 B, 179 BG, 123/179 R, 198 DB, 198 DC; 307/10.6; 200/61.85

[56] References Cited

U.S. PATENT DOCUMENTS

| | | | |
|---|---|---|---|
| 4,213,513 | 7/1980 | Beck | 123/198 DC |
| 4,508,944 | 4/1985 | Yashima et al. | 200/61.85 |
| 4,570,078 | 2/1986 | Yashima et al. | 200/61.85 |
| 4,710,599 | 12/1987 | Motodate et al. | 200/61.85 |

*Primary Examiner*—Andrew M. Dolinar
*Attorney, Agent, or Firm*—Ernest A. Beutler

[57] ABSTRACT

An improved control device for a small watercraft that contains start and stop buttons as well as a main ignition switch and is adapted to be mounted on the handlebar of the watercraft. The start and stop buttons are positioned on opposite sides of the control box so as to avoid the likelihood of inadvertent operation of the wrong control as also so as to make a more compact assembly.

5 Claims, 2 Drawing Sheets

STARTING-STOPPING DEVICE FOR SMALL SIZED JET PROPULSION BOAT

BACKGROUND OF THE INVENTION

This invention relates to a starting and stopping device for a small sized jet propulsion boat and more particularly to an improved, compact control for such a boat.

A popular type of small watercraft is of the jet propulsion type and is designed to accommodate primarily a single rider seated in straddle fashion and who operates the watercraft by moving a handlebar assembly for steering purposes. Frequently, the watercraft is provided with certain controls for the engine such as an electrical starter control, a kill switch and a safety switch that stops the engine if the rider becomes inadvertently displaced and which insures that the watercraft cannot be operated unless the rider is in position. Oftentimes, this type of control device is mounted on the handlebar and the starting and stopping switches are disposed adjacent to each other.

Such a prior art arrangement is shown in FIG. 1 wherein the handlebar is indicated at 11 and has a control box 12 affixed to it in a suitable manner. The control box operates a keyed main ignition switch 13 which will also stop the engine if the key is removed. There are provided in side by side relationship a start button 14 and a stop button or kill switch 15. As may be readily apparent, the side by side relationship of the start and stop buttons 14 and 15 necessitates a fairly wide length L for the control box 12. In addition, the close juxtaposition of these two buttons to each other obviously gives rise to the possibility of inadvertent improper or incorrect control.

It is, therefore, a principal object of this invention to provide an improved control device for a small sized watercraft.

It is a further object of this invention to provide a compact control device for a small watercraft wherein inadvertent operation of the wrong control is avoided.

DETAILED DESCRIPTION OF THE PREFERRED EMBODIMENT OF THE INVENTION

Figure 2:
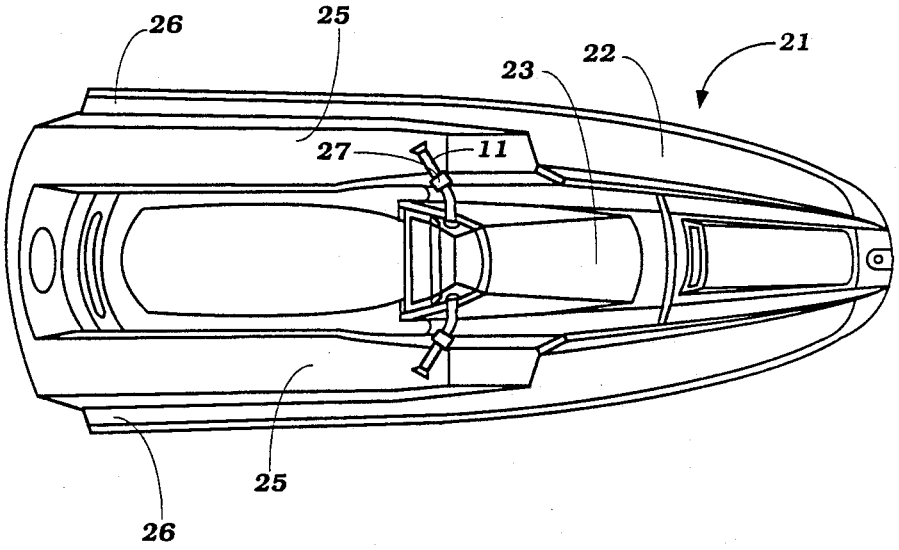
FIG. 2 is a top plan view of a small watercraft constructed in accordance with an embodiment of the invention.

Referring first to FIG. 2, a small watercraft constructed in accordance with an embodiment of the invention is identified generally by the reference numeral 21. The watercraft 21 is comprised of a hull 22 defining a forward portion that is closed by a hatch cover 23. A suitable internal combustion (not shown) that may include an electric starter is disposed beneath the hatch cover 23. The steering handlebar assembly 11 is disposed rearwardly of the hatch cover 23 and forwardly of a rider's seat 24. A pair of rider's foot areas 25 are disposed on opposite sides of the seat 24 so a driver and/or riders may become seated on the seat 24 with their feet in the foot areas 25. Side decks 26 are disposed outwardly of the foot areas 25 and are raised slightly relative to them. Basically, the construction of the watercraft as thus far described may be considered to be conventional and because of this further details are not believed to be necessary to understand the construction and operation of the invention.

Figure 3:
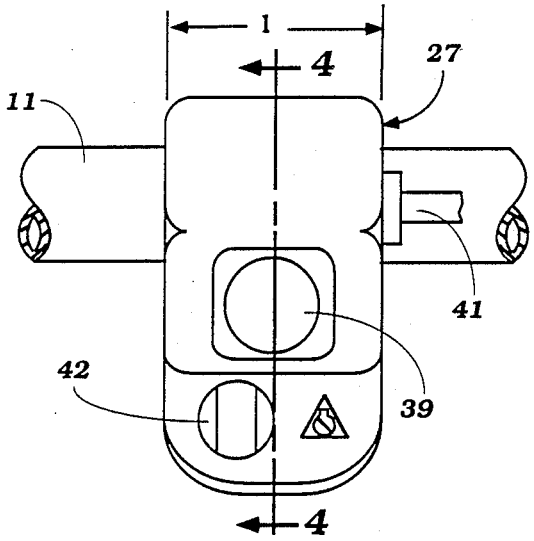
FIG. 3 is a rear elevational view of the control device of this embodiment.
Figure 4:
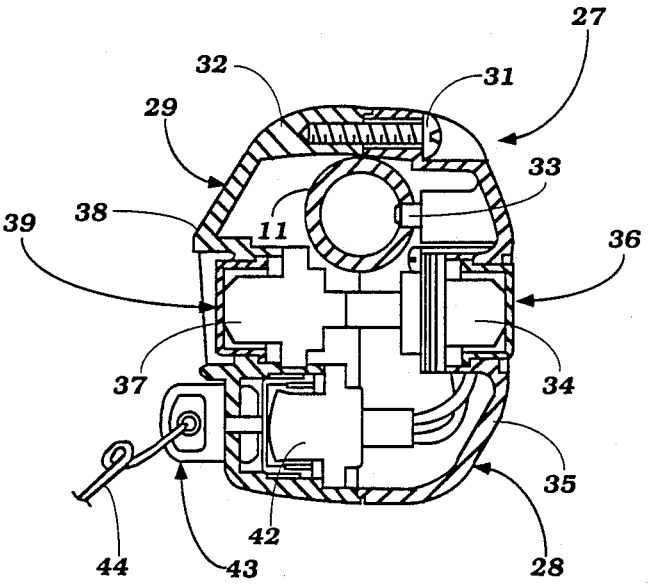
FIG. 4 is a cross-sectional view taken generally along the line 4—4 of FIG. 3.

Referring now primarily to FIGS. 3 and 4, a control device, indicated generally by the reference numeral 27 is designed so as to be detachably affixed to the handlebar 11 for operation of the watercraft and control of certain of its functions. The control device 27 is comprised of an outer housing consisting of a forward portion 28 and a rearward portion 29 that have suitable recesses so as to accommodate the handlebar 11. The housing pieces 28 and 29 are affixed to each other by means of threaded fasteners 31 that are threaded into threaded openings formed in a flange part 32 of the housing piece 29. It should be noted from the figures and particularly FIGS. 3 and 4 that the housing pieces 28 and 29 when connected together form a generally rectangular cross-sectional configuration having a front face, a rear face, a top face and a bottom face. The housing piece 28 has a pin-like projection 33 that is received within a corresponding recess formed in the handlebar 11 so as to hold the assembly 27 against movement relative to the handlebar assembly 11.

A starter switch 34 is supported within a front face 35 of the housing piece 28 and has an actuating button 36 that can be operated by the finger of the operator and which will kill the engine in a suitable manner.

In addition, a kill switch mechanism 37 is mounted in a rear face 38 of the housing piece 29 and has an actuating button 39 that can be depressed so as to kill the engine in a known manner. The controls are transmitted to the engine through externally positioned wires 41 in a known manner.

On the rear face 38 of the housing piece 27 there is also provided a main ignition switch 42 that receives a key 43 that is connected by means of a wire 44 to the operator so that if the operator becomes displaced from the seat, the engine will be stopped. As in the prior art constructions, the key 43 must be inserted in the switch 42 for the engine to be operated and if the rider falls overboard, the wire 44 will cause the key 43 to be withdrawn and this will stop the engine for ease of reentry by the rider.

Figure 1:
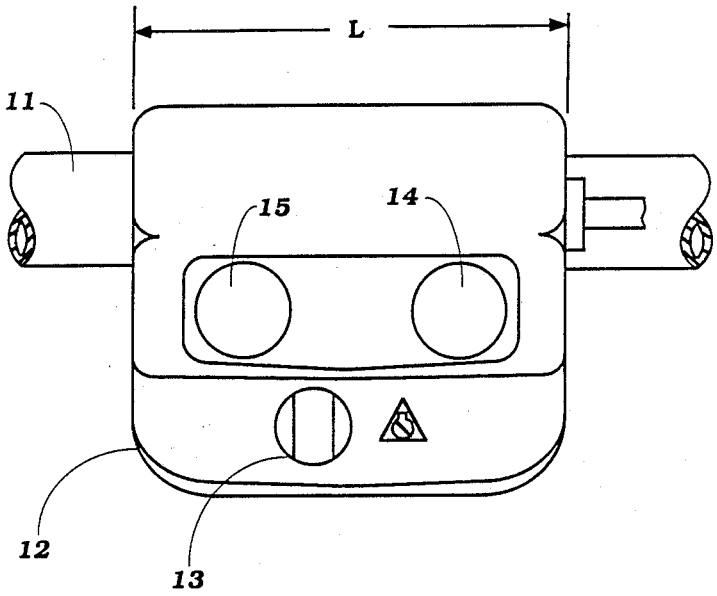
Figure 1 Prior Art
FIG. 1 is a rear elevational view of a control device constructed in accordance with a prior art type of construction.

It should be noted that because the start switch button 36 and stop switch button 39 are positioned on the front and rear faces of the housing 27 rather than in side by side relationship, the width 1 may be considerably less than the prior art constructions as clearly shown in the comparison between FIGS. 1 and 3. Furthermore, because the start and stop buttons 36 and 39 are not disposed adjacent each other, there is less likelihood of inadvertent operation of the wrong button. Furthermore, the forward facing starter button makes it more difficult to access and hence it is even less unlikely that it will be inadvertently operated.

It should be readily apparent from the foregoing description that the embodiment of the invention is well calculated to fulfill the objects aforenoted. Although this is the case, various changes and modifications may be made without departing from the spirit and scope of the invention as defined by the appended claims.

I claim:

1. A control device for a vehicle powered by an engine and steered by a handlebar, a control box affixed to said handlebar and having a front facing side, a rear facing side, a top facing side, and a bottom facing side, a start control for starting the operation of the engine and having an operator positioned on one of said facing sides for operator access, and a stop control for stopping said engine and having an operator positioned on another facing side of said control box for operator access, said start control operator being moveable in a different direction for its operation than said stop control operator.

2. A control device as set forth in claim 1, wherein the operators for the start control and stop control are positioned on opposite facing sides of the control box.

3. A control device as set forth in claim 1, further including a main ignition switch carried on one of the facing sides of the control box.

4. A control device as set forth in claim 3, wherein the main ignition switch is positioned on the same facing face of the control box as the stop operator.

5. A control device for a vehicle powered by an engine and steered by a handlebar, a control box affixed to said handlebar and having a front facing side, a rear facing side, a top facing side, and a bottom facing side, a start control for starting the operation of the engine and having an operator positioned on one of said facing sides for operator access, and a stop control for stopping said engine and having an operator positioned on another facing side of said control box for operator access, said start and stop operators being positioned respectively on the front and rear facing sides of the control box.

* * * * *